US009828177B2

(12) United States Patent
Nussbaum et al.

(10) Patent No.: US 9,828,177 B2
(45) **Date of Patent: *Nov. 28, 2017**

(54) WASTE CONTAINER WITH GRAVITY LATCH AND LATCH DEACTIVATION SYSTEM

(71) Applicant: Orbis Corporation, Oconomowoc, WI (US)

(72) Inventors: Robert G. Nussbaum, Oconomowoc, WI (US); Joachim Banik, Oconomowoc, WI (US); Steve R. Howe, Cottage Grove, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/530,077

(22) Filed: Oct. 31, 2014

(65) Prior Publication Data

US 2015/0053684 A1 Feb. 26, 2015

Related U.S. Application Data

(63) Continuation-in-part of application No. 14/184,006, filed on Feb. 19, 2014, now Pat. No. 9,376,255.

(Continued)

(51) Int. Cl.
*B65F 1/16* (2006.01)
*E05B 15/00* (2006.01)

(52) U.S. Cl.
CPC ..... *B65F 1/1615* (2013.01); *E05B 15/0093* (2013.01); *Y10S 220/908* (2013.01)

(58) Field of Classification Search
CPC ... B65F 1/1615; E05B 15/0093; B65D 45/00; B65D 45/16; B65D 2251/1025; Y10S 220/908

(Continued)

(56) References Cited

U.S. PATENT DOCUMENTS 1,742,075 A 12/1929 Houghten
3,257,157 A * 6/1966 Jay ..... 312/328

(Continued)

FOREIGN PATENT DOCUMENTS

CA 99947 7/2003
CA 2372465 A1 8/2003

(Continued)

OTHER PUBLICATIONS

Extended European Search Report for EP 14156218.1 dated Apr. 14, 2014.

(Continued)

*Primary Examiner* — Fenn C Mathew
*Assistant Examiner* — Elizabeth Volz
(74) *Attorney, Agent, or Firm* — Greensfelder, Hemker & Gale, P.C.

(57) ABSTRACT

A waste container having a body and a lid pivotably connected to the body. The lid includes a gravity activated locking mechanism having a latch that engages the lid to the body when the container is in an upright position. The locking mechanism rotates to disengage the latch and allow the lid to open when the container is inverted for dumping the waste. The waste container further including a slideable member that is engageable with a locking member when the container is not in an upright position or inverted for dumping, to prevent rotation of the locking mechanism and opening of the lid. The container further including a deactivation system to prevent the lid from locking when the container is upright.

21 Claims, 16 Drawing Sheets

Related U.S. Application Data

(60) Provisional application No. 61/768,049, filed on Feb. 22, 2013.

(58) Field of Classification Search
USPC ..... 220/324, 835, 908, 260, 315, 318, 326; 292/230, 236, 148, 231, 130, 57, 63, 95, 292/194, 131, 136, 238
See application file for complete search history.

(56) References Cited

U.S. PATENT DOCUMENTS 3,825,150 A 7/1974 Taylor
3,916,456 A 11/1975 Persson
4,180,176 A * 12/1979 Galer ..... 217/57
4,182,530 A 1/1980 Hodge
4,349,121 A 9/1982 Lafferty
D291,738 S 9/1987 Orlowski
4,753,367 A 6/1988 Miller et al.
4,967,927 A 11/1990 Reiland et al.
4,984,561 A 1/1991 Warrington
4,992,018 A 2/1991 Prout et al.
5,035,563 A 7/1991 Mezey
5,056,979 A 10/1991 Niederer et al.
D323,912 S 2/1992 Delmerico
5,085,341 A * 2/1992 Hodge ..... 220/811
5,088,750 A 2/1992 Beese et al.
D324,595 S 3/1992 Beese et al.
5,094,358 A 3/1992 Serio, Sr.
5,094,487 A * 3/1992 Drewry ..... B65F 1/1615 220/908
5,103,994 A * 4/1992 Doxey et al. ..... 220/324
5,104,198 A 4/1992 Prout et al.
5,104,200 A 4/1992 Prout et al.
5,149,153 A * 9/1992 Drewry et al. ..... 292/104
5,160,063 A 11/1992 Bailey
5,163,805 A 11/1992 Mezey
5,169,012 A 12/1992 Labrie
5,183,180 A 2/1993 Hawkins et al.
5,184,836 A 2/1993 Andrews, Jr.
5,199,592 A 4/1993 Reiland et al.
5,205,698 A 4/1993 Mezey
5,224,744 A * 7/1993 Michelutti ..... 292/234
D345,837 S 4/1994 Bean
5,303,841 A 4/1994 Mezey
D347,095 S 5/1994 Apps et al.
5,377,858 A 1/1995 Morris, Sr.
D355,741 S 2/1995 Craft et al.
5,415,314 A 5/1995 McCollum
5,445,397 A 8/1995 Evans
D365,428 S 12/1995 Prout et al.
5,474,341 A 12/1995 Putman et al.
5,503,292 A 4/1996 Cuccharia
5,538,158 A 7/1996 Prout et al.
5,547,104 A 8/1996 Parker
5,555,996 A 9/1996 Lang-Ree et al.
D374,530 S 10/1996 Prout et al.
5,582,322 A 12/1996 Prout et al.
5,585,419 A 12/1996 Prout et al.
D388,577 S 12/1997 Rehrig et al.
5,772,264 A * 6/1998 Bettenhausen ..... 292/130
D398,120 S 9/1998 Rehrig et al.
5,816,591 A 10/1998 Parker et al.
D401,727 S 11/1998 Weideman et al.
5,881,901 A 3/1999 Hampton
5,886,068 A 3/1999 Prout et al.
5,899,468 A 5/1999 Apps et al.
5,947,295 A 9/1999 Lutin
D416,367 S 11/1999 Dickinson et al.
D429,398 S 8/2000 Wysocki
D445,228 S 7/2001 Apps et al.
6,276,557 B1 8/2001 Wysocki
6,290,093 B1 * 9/2001 Obriot et al. ..... 220/835
6,471,221 B1 10/2002 McGarry
D465,348 S 11/2002 Lucatello
D471,336 S 3/2003 Tuduri
D471,685 S 3/2003 Taylor et al.
D478,197 S 8/2003 Raghunathan
6,666,485 B1 * 12/2003 Moret ..... 292/130
D491,328 S 6/2004 Aiken et al.
6,843,386 B2 1/2005 Raghunathan et al.
6,918,508 B2 7/2005 Hwang
D515,313 S 2/2006 Uffner et al.
7,017,773 B2 3/2006 Gruber et al.
7,048,346 B2 5/2006 Saravis
7,114,631 B2 10/2006 Aiken et al.
7,121,564 B2 10/2006 Hassell
D532,173 S 11/2006 Aiken et al.
D535,448 S 1/2007 Kilduff et al.
7,172,088 B2 2/2007 McDade et al.
7,287,665 B2 10/2007 Meissen et al.
7,405,927 B2 * 7/2008 Lev ..... E05C 19/163 292/121
D577,170 S 9/2008 Meers
7,540,393 B2 6/2009 Wong
D600,943 S 9/2009 Austin et al.
D600,944 S 9/2009 McConnell et al.
D624,723 S 9/2010 Raghunathan et al.
D643,174 S 8/2011 Raghunathan et al.
7,988,009 B2 * 8/2011 Cavalcante ..... 220/324
8,028,940 B2 10/2011 Kelly et al.
D654,723 S 2/2012 Gormezano
D656,730 S 4/2012 Son
8,360,445 B2 1/2013 Meers et al.
8,366,156 B2 * 2/2013 Mercier et al. ..... 292/80
8,424,715 B2 4/2013 Aiken et al.
8,448,812 B2 5/2013 Gruber et al.
8,485,381 B2 * 7/2013 Raghunathan et al. ..... 220/324
8,485,382 B2 7/2013 Raghunathan et al.
8,511,502 B2 8/2013 Wong
9,376,255 B2 * 6/2016 Banik ..... B65F 1/1615
2003/0168466 A1 * 9/2003 Spiers et al. ..... 220/835
2004/0074913 A1 4/2004 McDade et al.
2005/0029763 A1 2/2005 Hassell
2006/0065657 A1 * 3/2006 Wong ..... 220/324
2006/0076260 A1 4/2006 Luburic
2006/0138156 A1 6/2006 Kellerer et al.
2006/0236612 A1 10/2006 Sheng et al.
2009/0107998 A1 4/2009 Meissen
2009/0223965 A1 9/2009 Raghunathan et al.
2010/0037565 A1 2/2010 Meissen
2010/0108675 A1 5/2010 Meissen et al.
2010/0314404 A1 12/2010 Baltz
2011/0024430 A1 2/2011 Meissen et al.
2011/0049151 A1 3/2011 Raghunathan et al.
2011/0049152 A1 3/2011 Raghunathan et al.
2011/0274525 A1 11/2011 Mercier et al.
2013/0119625 A1 5/2013 Foster
2013/0334229 A1 12/2013 McCanless
2014/0027454 A1 1/2014 Banik
2015/0021326 A1 * 1/2015 Giraud ..... A61J 1/03 220/254.1

FOREIGN PATENT DOCUMENTS

CA 2418583 A1 8/2003
CA 2521412 A1 3/2006
CA 2330996 A 8/2007
CA 125054 4/2009
CA 126678 4/2009
CA 2624658 A1 9/2009
CA 2624663 A1 9/2009
CA 2636306 A1 9/2009
CA 2843339 A1 8/2014
DE 2646175 4/1978
DE 29511098 11/1996
EP 0872432 A1 10/1998
EP 1081063 A1 3/2001
EP 2769933 A1 8/2014

(56) References Cited

FOREIGN PATENT DOCUMENTS

| | | | |
|---|---|---|---|
| GB | 2361742 | A | 10/2001 |
| GB | 2453055 | A | 3/2009 |

OTHER PUBLICATIONS

Franzen International Security Prods. Inc.; "Trash Bin Gravity Lock," retrieved from <http://www.franzenint.com/trash-bin-gravity-locks.html>.

* cited by examiner

WASTE CONTAINER WITH GRAVITY LATCH AND LATCH DEACTIVATION SYSTEM

CROSS-REFERENCE TO RELATED APPLICATIONS

The present application is a continuation-in-part application of U.S. Ser. No. 14/184,006 filed Feb. 19, 2014, which claims the benefit of U.S. Provisional Application Ser. No. 61/768,049 filed Feb. 22, 2013, the contents of which are incorporated herein by reference.

FEDERALLY SPONSORED RESEARCH OR DEVELOPMENT

N/A

FIELD OF THE INVENTION

The present invention generally relates to a latch mechanism for a waste container having a body and a lid pivotably connected to the body and structure for deactivating the latch mechanism.

BACKGROUND OF THE INVENTION

One problem with waste containers that are stored outside and that contain organic materials is the entry of pets, rodents, and vermin. In particular, raccoons have been shown to be very skillful in the art of getting to the contents of communal and commercial waste containers.

Some containers, especially those designated for the collection of organic waste, have elaborate latch mechanisms that make it difficult for animals to actuate, but allow the human user to open and close the lid with one hand for filling.

To save costs, more and more municipalities use automated trucks to collect waste. These trucks are manned by one driver, who operates the unloading of containers via joystick-controlled grab arms and cameras. This means that any latch mechanism on the container needs to be automatically unlatched during dumping because the driver does not leave the truck in normal operation.

One known solution to the problem is to add a sliding weight to the arm of the truck that actuates a latch on the container. A downside to this type of system is that it requires a specialized arm or a modification to existing dump trucks.

To overcome the need to have to modify the dump system, gravity latches have been developed that unlock the lid of a waste container when a certain tilt angle is reached. Known mechanisms include: U.S. Pat. No. 5,094,358 LOCKING MECHANISM FOR CONTAINER LID; U.S. Pat. No. 5,474,341 GRAVITY ACTUATED CONTAINER LOCK; U.S. Pat. No. 5,415,314 GRAVITY LOCKING MECHANISM EMPLOYING FIRST AND SECOND PENDULUMS FOR SECURING THE LID OF A REFUSE CONTAINER; and FRANZEN International offers a gravity lock for trash carts (http://www.franzenint.com/trash-bin-gravity-locks.html).

The present invention provides an improved waste container with a gravity activated latch mechanism.

SUMMARY OF THE INVENTION

The present invention provides a waste container having a container body and a lid pivotably attached to the container body. The waste container is provided with a gravity locking mechanism in the lid for locking the lid to the container body when in an upright position, and for disengaging the lock when the container is inverted (typically by automatic dumping equipment). Inverting the container causes a weight in the mechanism to rotate a lever connected to a latch to disengage the latch and allow the lid to open.

In accordance with one embodiment, a waste container with a gravity locking mechanism is provided. The waste container includes a container body having an open top portion and a catch on a front portion of the top portion. A lid is pivotably connected to the top portion of the container body. A locking mechanism is connected to the lid. The locking mechanism includes a rotatable member having an axis of rotation; a latch configured to engage the catch when the lid is pivoted to a closed position and a weight. A lever connects the rotatable member, latch and weight. The locking mechanism is configured so that placement of the container in an upside down position causes the weight to rotate the lever about the axis of rotation of the rotatable member to disengage the latch from the catch to enable opening of the lid.

The rotatable member can be positioned at a first end of the lever above the latch. The weight can be positioned at a second end of the lever. The weight can be a separate piece of material, such as steel or other similar material, and can be secured to the locking mechanism by a push-in fastener or other similar means. Alternatively, the weight does not have to be a separate piece of material. Instead, the weight can be made from the same material used for the lever and be integrally formed therewith.

The waste container can include a button in a front portion of the lid. The button can be slideably configured to disengage the latch from the catch when the container is in an upright position to enable opening of the lid. A variety of other mechanisms could also be used to allow a user to manually unlatch the lid when upright. For example: a rotatable knob or key, a secondary lever, or a rigid extension of the main lever that protrudes through the lid, or other known means could also be used.

The container body can include wheels connected to a lower portion of the container body to facilitate movement of the container. Additionally, the container body can include features to facilitate use with automatic dumping equipment. The lid can also be provided with a handle.

The lid can also be provided with a cover plate having a portion positioned between the locking mechanism and the container body. The cover plate separates the locking mechanism from the interior of the container body and prevents waste from contacting or otherwise interfering with the locking mechanism.

In accordance with another aspect of the invention, a waste container with a gravity activated latch in the lid is provided. The waste container comprises a container body having a bottom and a sidewall extending upward from the bottom to a top opening. The container body includes an inwardly directed protrusion proximate the top opening. A lid is pivotably connected at a first end to a first side of the top opening of the container body. A lock having a rotatable member is connected to an interior portion of the lid proximate a second end of the lid opposed from the first end. A first arm extends from the rotatable member. The first arm has a latch element for engaging the protrusion on the container body when the waste container is in an upright position and preventing the lid from opening. A second arm extends from the rotatable member toward the interior of the container.

The first arm extends generally vertically downward when the lid is in a closed position over the opening and the waste container is in an upright position. The second arm extends generally horizontally when the lid is in a closed position over the opening and the waste container is in an upright position. The first arm and second arm are preferably at a right angle.

The second arm includes a first end connected to the rotatable member and a second end distal from the rotatable member. A weight is connected to the second arm proximate the second end. The weight can be steel or some other suitable material. The weight is connected to the second arm by a push-in fastener or can be molded into the second arm.

A cover plate can be connected to an interior portion of the lid. The cover plate separates the second arm from the interior of the container body when the lid is in a closed position. The cover plate includes an opening to enable the first arm to engage the protrusion of the container body. The cover plate prevents materials in the container body from interfering with rotation of the lock.

The waste container can further comprise a moveable member connected to one of the lever and the lid, and a locking member connected to the other of the lever and the lid that is engageable with the moveable member to prevent rotation of the rotatable member. The moveable member moves to a locking position when the container is not in one of an upright position and an upside position (e.g., when the container is pushed on its side).

The container body can be formed from plastic or other similar materials. Similarly, the lid can also be formed from plastic or other similar materials.

In accordance with another embodiment of the invention, a waste container with a gravity latch that will not open if the container is moved into an improper position (e.g., on its side) is provided. The waste container comprises a container body having a bottom wall, a side wall extending upward from the bottom wall, and an open top. A lid is pivotably connected to the open top at one end. A gravity locking mechanism having a latch arm, a rotatable hinge portion, a latch connected to a first end of the latch arm and a first weight connected to the latch arm is connected to the lid. The latch is engageable with the container body when the container is in an upright position (keeping the lid locked to the container body) and disengageable with the container body when the container is in an upside down position by rotation of the latch arm due to gravity (allowing the lid to open to dispel any contents of the container body). The waste container further comprises a moveable (e.g., slideable or pivotable) member connected to one of the lid and the latch arm, and a locking member on the other of the lid and the latch arm. The moveable member is configured to move to engage the locking member when the container is not one of upright or upside down (e.g., pushed onto its side) to prevent rotation of the locking mechanism and unwanted opening of the lid. Moreover, the moveable member and locking structure can be used on containers having different gravity or other types of locking mechanisms.

The moveable member can be a second weight having a central opening allowing for slideable movement about a post. The locking structure can be a ledge positioned to engage the weight when the container is moved to an improper position (which causes the weight to slide to an engaging position). The second weight can be positioned on the latch arm (e.g., by the first weight) and the locking structure can be a ledge connected to the lid or a portion of the cover plate.

The waste container can further comprise a spring (such as a torsion spring) connected to the rotatable hinge portion, the latch arm and the latch. This enables movement of the latch with respect to the latch arm upon application of a force on the latch (e.g. by a push button) sufficient to overcome the spring force. This allows for opening of the container regardless of rotation of the latch arm of the locking mechanism (e.g., when the moveable member is engaged with the locking structure).

In accordance with another aspect of the present invention, a latch deactivation system is provided. The latch deactivation system prevents the lid from locking to the container body when the container is in an upright position. This may be used, for example, when the container is placed in an area that does not require it to be locked when upright (e.g., in a warehouse or other similar location). That is, an environment where wild animals are not likely to have any access to the container.

In one embodiment, a container with a latch deactivation system comprises a container body having an open top portion and a catch mechanism connected proximate the top portion. The catch mechanism has a catch portion moveable from a first position to a second position. A lid is pivotably connected to the top portion of the container body. A latch hook is connected to the lid. The latch hook is aligned to engage the catch portion of the catch mechanism when the catch portion is in the first position to lock the lid to the container body when the lid is closed. The latch hook does not engage the catch portion when the catch portion is in the second position to keep the lid unlocked when the lid is closed. That is, when the catch portion is in the first position, the lock is activated (i.e., the catch portion is aligned to engage the latch hook and lock the container), and in the second position, the lock is deactivated (i.e., the catch portion is not aligned with the latch hook and cannot engage it when the lid is closed).

The catch mechanism can include a platform supporting the catch portion. The catch mechanism can be mounted to the container body for rotational movement to move the catch portion from the first position to the second position.

The platform can be oval and include a tab extension at one end. The container body can include a first stop that contacts the tab extension and limits rotational movement of the platform when the catch portion is moved to the second position. The container body can also include a second stop to prevent further rotational movement when moved back to the first position. Additionally, the second stop can include an overhang that engages the tab extension when the catch portion is in the first position. This helps prevent the catch mechanism from being pulled off the container body when one attempts to open the lid when in the locked position.

Alternatively, the catch mechanism can be mounted for linear (e.g., sliding) movement to move the catch portion from the first position to the second position. The container body can include a first groove (and a second or additional grooves) which cooperates with structure in the platform for the linear movement (e.g., a rivet like structure).

In accordance with another embodiment of the invention, a waste container is provided that includes a lock deactivation system. The waste container comprises a container body having a bottom and a sidewall extending upward from the bottom to a top opening. A lid is pivotably connected at a first end to a first side of the top opening of the container body. A catch mechanism is connected to the container body proximate the top opening. The catch mechanism includes a catch portion moveable from a first position to a second position. A lock including a rotatable member is connected to an interior portion of the lid. A first arm extends from the rotatable member and has a latch element for engaging the catch portion of the catch mechanism on the container body when the waste container is in an upright position and the catch portion is in the first position to lock the lid. The latch element does not engage the catch portion when the catch portion is in the second position.

The catch mechanism can be rotatably mounted to the container body. A first stop can be positioned on a first side of the catch mechanism and a second stop can be positioned on a second side of the catch mechanism. The first stop prevents further rotational movement of the platform once the catch portion is in the second position. The second stop prevents further rotational movement when moving the catch portion back to the first position. The second stop can include an overhang portion to assist in holding the latch mechanism to the container body when the catch portion is in the first position.

The catch mechanism can alternatively be slidably mounted to the container body. The container body can include a first groove and a second groove configured to cooperate with the catch mechanism for the slideable movement.

In a further embodiment of the invention, a waste container with a gravity latch and a latch deactivating system is provided. The waste container comprises a container body having a bottom wall, a side wall extending upward from the bottom wall, and an open top. A lid is pivotably connected to the open top. A gravity locking mechanism having a latch arm, a rotatable hinge portion, a latch element is connected to a first end of the latch arm and a first weight connected to the latch arm. A catch portion is on the container body. One of the catch portion and the latch element is moveable from a first engaging position to a second non-engaging position.

The waste container can include the catch portion being rotationally moveable from the first engaging position to the second non-engaging position. Alternatively, the latch element can be rotationally moveable from the first engaging position to the second non-engaging position.

Further aspects of the invention are disclosed in the Figures and are described herein.

BRIEF DESCRIPTION OF THE DRAWINGS

To understand the present invention, it will now be described by way of example, with reference to the accompanying figures in which.

DETAILED DESCRIPTION

While this invention is susceptible of embodiments in many different forms, there is shown in the Figures and will herein be described in detail preferred embodiments of the invention with the understanding that the present disclosure is to be considered as an exemplification of the principles of the invention and is not intended to limit the broad aspect of the invention to the embodiments illustrated.

Figure 1:
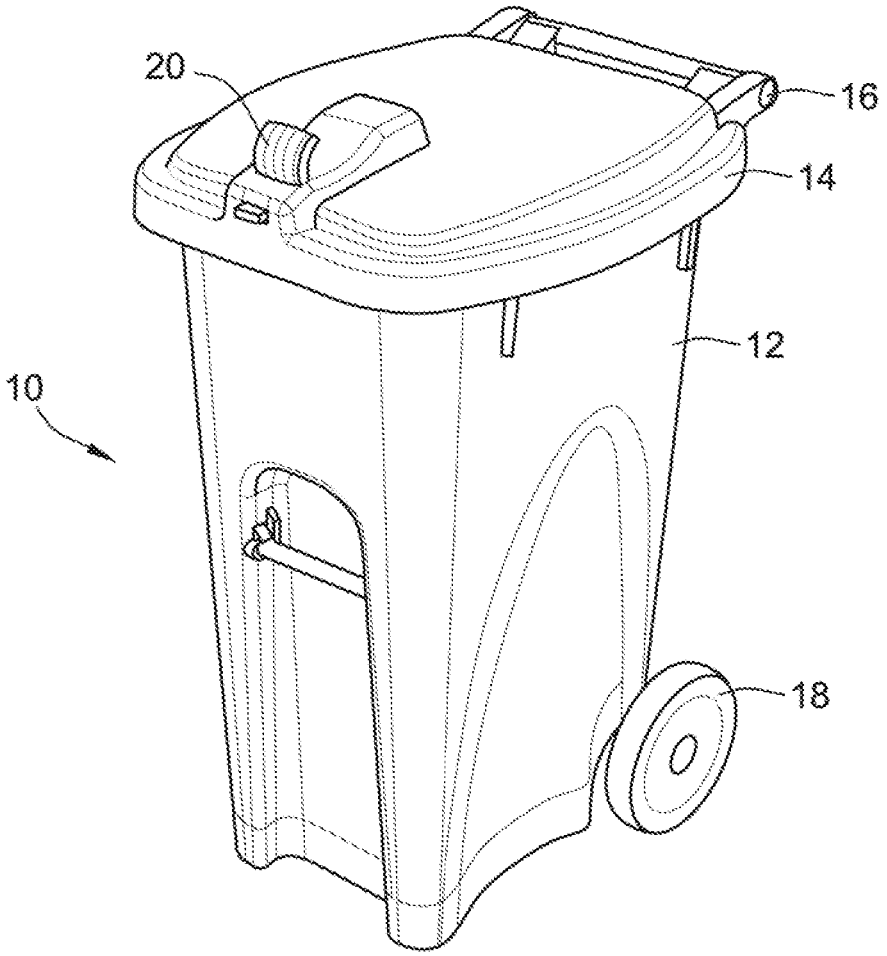
FIG. 1 is a perspective view of a first embodiment of a waste container having a body and lid pivotably connected to the body.

As illustrated in FIG. 1, a waste container 10 includes a container body 12 and a lid 14 pivotably connected at one end to the container body 12 by a hinge element 16. The container body 12 includes a bottom and sidewalls extending upward from the bottom to an open top portion (which can be selectively covered by the lid 14). The container body 12 also includes wheels 18 on a lower portion of the body 12. The lid 14 includes a handle 20 extending from an upper surface of the lid 14. The container body 12 and lid 14 can be formed from plastic or other similar or suitable materials.

Figure 2:
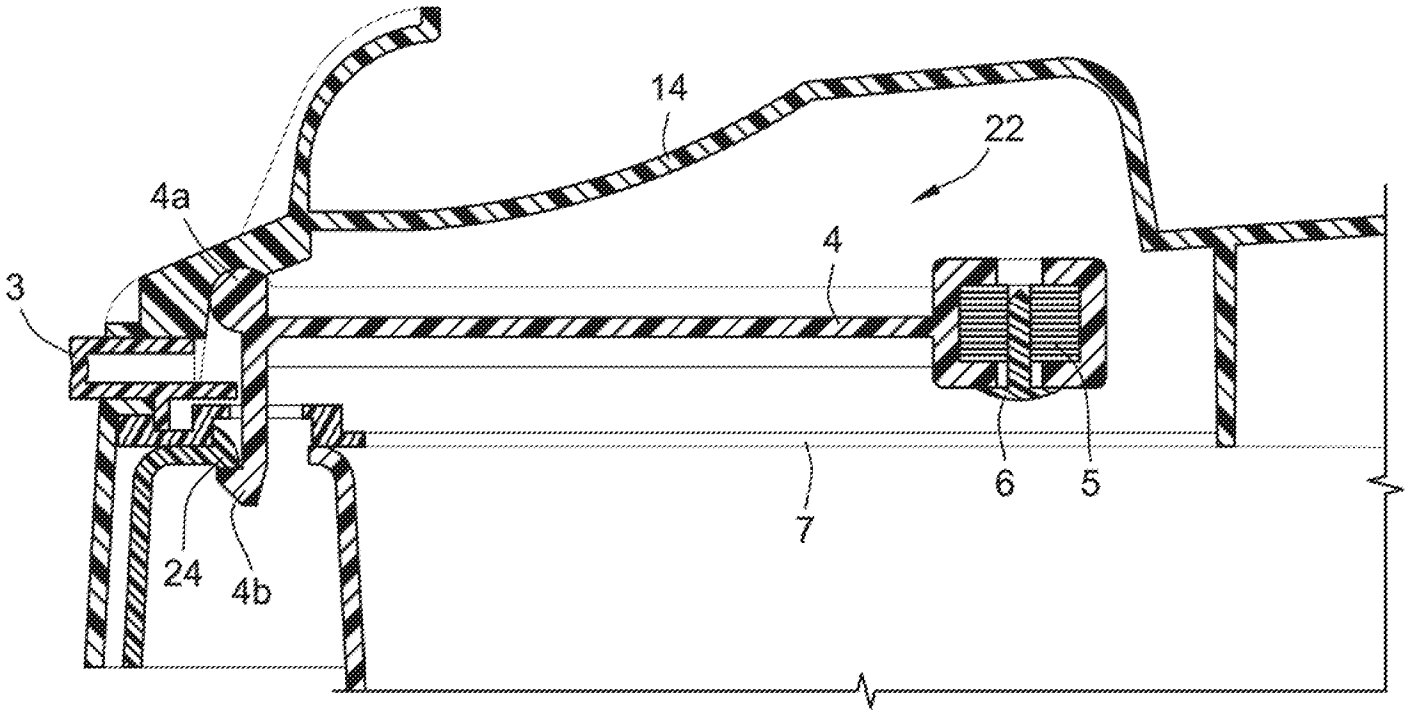
FIG. 2 is a cross-sectional view of a top portion of the container of FIG. 1 showing a latch feature in a latched position.

Referring to the cross-section of FIG. 2, a gravity actuated locking or latching mechanism 22 (i.e., lock) is shown. The mechanism 22 includes a latch lever 4 rotatably mounted to the lid 14 of the waste container 10. At a first end, the lever 4 includes a rotatable member 4*a* having an axis of rotation mounted to the underside of the lid 14 proximate the location of the handle 20. The rotatable member 4*a* having the axis of rotation can be a cylindrical axle or other similar structure that allows rotation of the lever and latch. At a second opposing end, the lever 4 includes a weight 5.

The locking mechanism 22 can be formed primarily out of plastic or other similar or suitable material. However, the weight 5 in the locking mechanism 22 can be steel (or other suitable material) that is fastened to the lever 4 by a push-in fastener 6. Alternatively, the weight 5 could be overmolded into the plastic of the lever 4, or could be fastened to the lever 4 by different means than those shown. Alternatively, the weight can be integrally formed with the lever (e.g., the same material). In this embodiment, the lever can be formed from a material with sufficient weight to enable rotation due to gravity.

A latch hook 4*b* is provided at the first end of the lever 4 below the rotatable member 4*a*. The latch hook 4*b* is designed to cooperate with an inwardly projecting protrusion, such as a catch 24 formed at the top of the container body 12. When the lid 14 is down covering the opening of the container body 12 (i.e., when the waste container 10 is right-side-up) the latch hook 4*b* engages the catch 24 and locks the lid 14 to the container body 12. The weight 5 at the second end of the lever 4 provides a downward force on the end of the lever 4 which causes the rotatable member 4*a* to rotate clockwise (in cross-section) and keeps the latch hook 4*b* in place against the catch 24 in this upright position.

Figure 3:
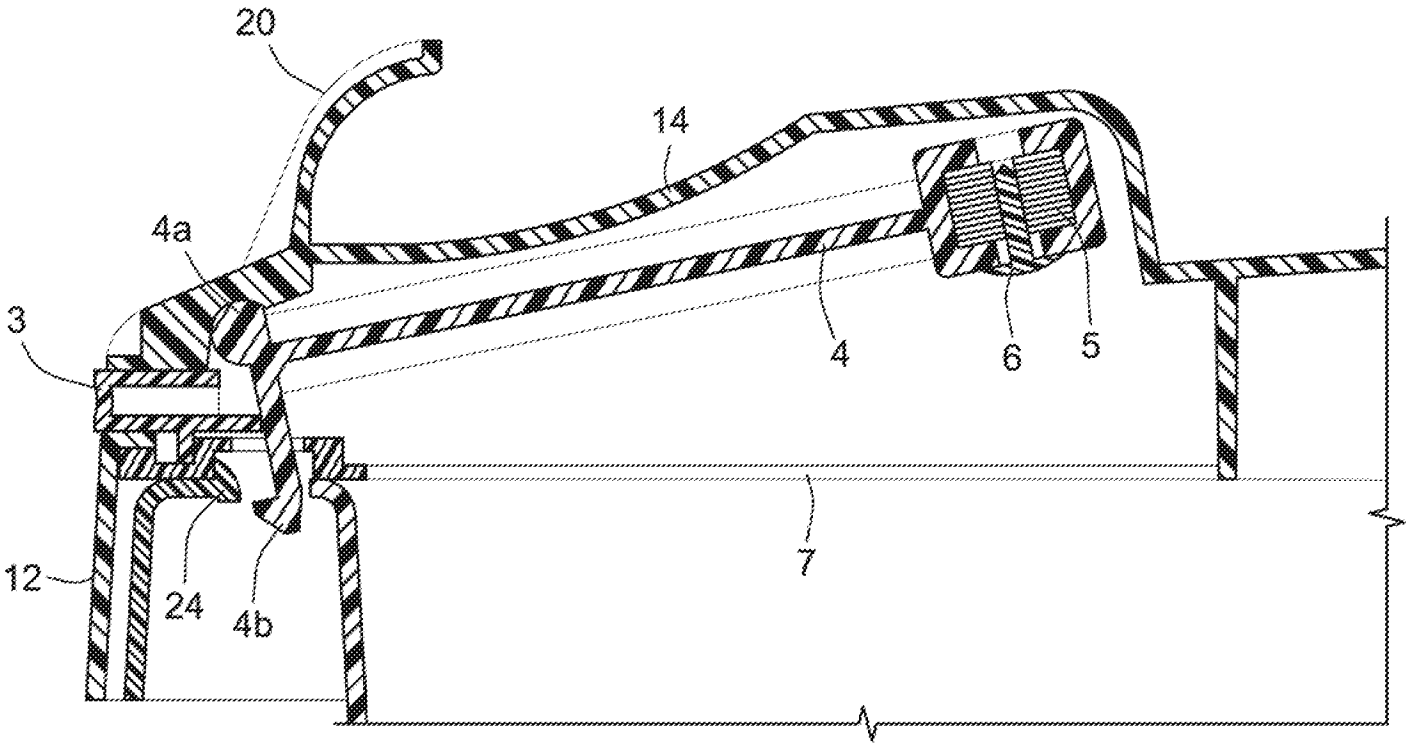
FIG. 3 is a cross-sectional view of the top portion of the container of FIG. 1 showing the latch mechanism in an unlatched position.

A push button 3 is slideably mounted at the front of the lid 14 to enable a user to manually disengage the latch hook 4*b* and open the lid 14 when the waste container 10 is in the upright position. As illustrated in FIG. 3, pushing in the button 3 pivots the latch hook 4*b* back and upward to disengage the catch 24 on the container body 12. The force to push the button 3 in this embodiment is affected by the weight 5, the distance from the weight 5 to the axis of rotation 4*a*, and the distance from the axis of rotation 4*a* to the point where the button 3 makes contact with the latch hook 4*b*. The amount of force needed to open the lid 12 can be adjusted by altering any of these three variables. The lid 14 is provided with a space for the weight 5 in the pivoted—unlatched position. When the lid 14 is lowered, the latch 4*b* will reengage the catch 24 and lock the lid 14 to the container body 12.

A cover plate 7 is positioned below the lever 4. A portion of the cover plate 7 separates the locking mechanism 22 from the interior of the waste container body 12. This protects the locking mechanism from contacting waste placed in the container, and prevents such waste from interfering with the mechanism during operation.

Figure 4:
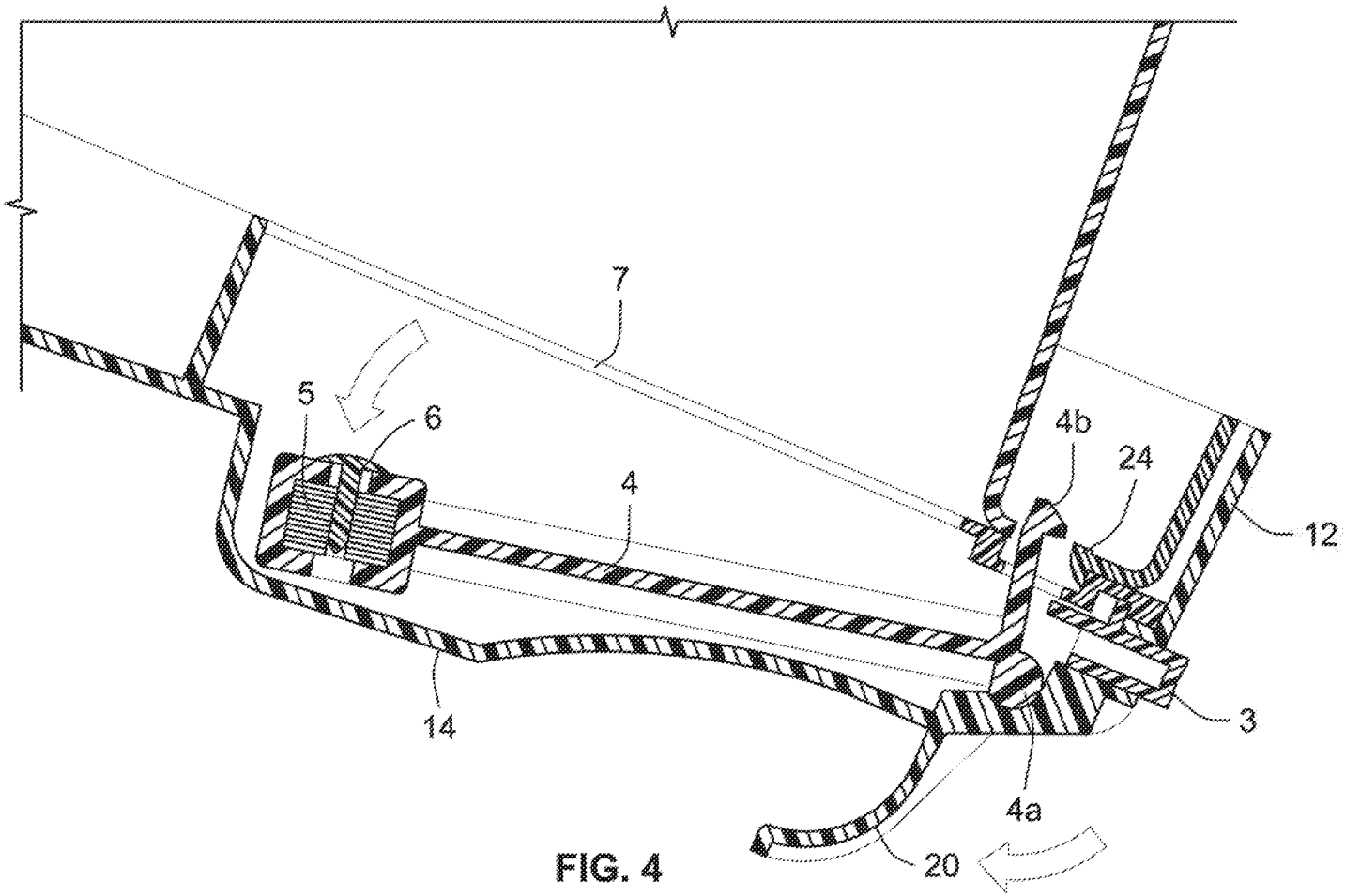
FIG. 4 is a cross-sectional view of the top portion of the container of FIG. 1 showing how gravity operates the latch mechanism to move it to the unlatched position to allow the lid to open during an automatic dumping operation.
Figure 5:
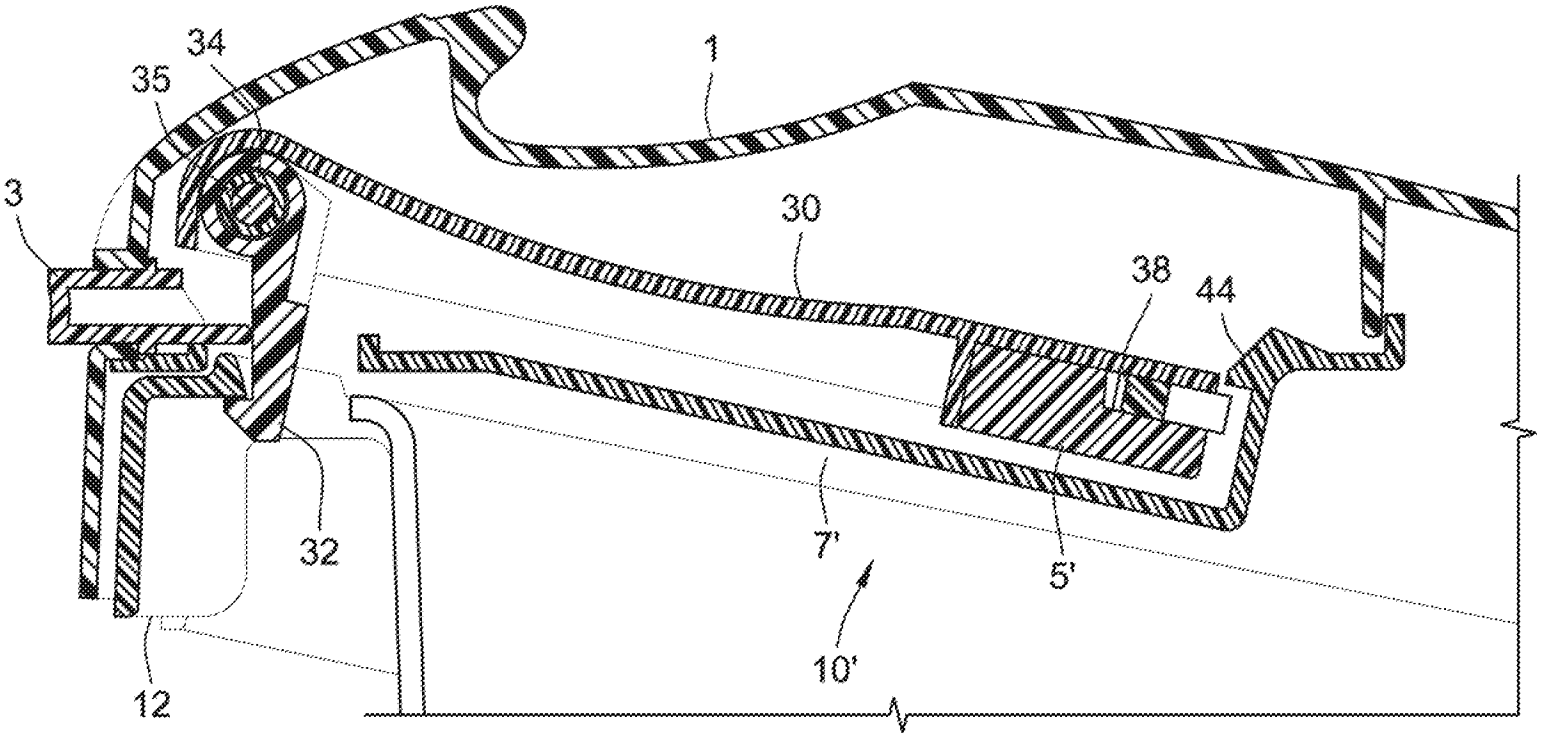
FIG. 5 is a cross-sectional plan view of the top portion of a second embodiment of a waste container having a body and lid pivotably connected to the body in an upright position.
Figure 6:
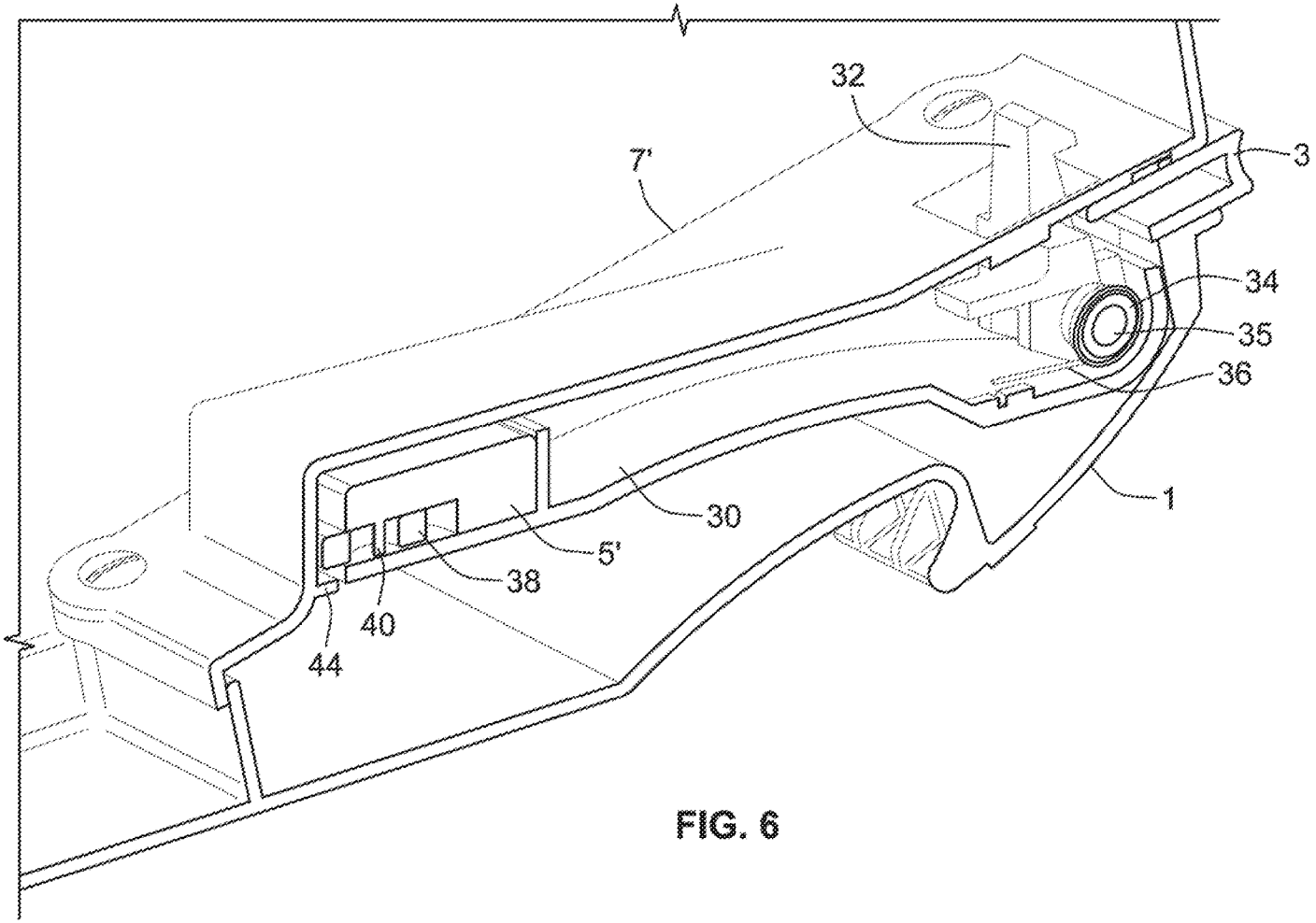
FIG. 6 is perspective cross-sectional view of the top portion of the container of FIG. 5 in an inverted position.

The locking mechanism 22 is configured to automatically (i.e., via gravity) unhook the latch hook 4*b* when the container 10 is turned upside down (e.g., by a waste disposal vehicle or other similar apparatus). As illustrated in FIG. 4, when the container 10 is turned upside down, the weight 5 causes the lever 4 to pivot about the axis of rotation 4*a* in a counter-clockwise direction which disengages the latch hook 4*b* from the catch 24. This allows the lid 14 to open under gravity.

As illustrated in FIGS. 1-4, the lever 4 has a first vertical arm (when the lid is closed and the container is in an upright position) extending downward from the rotatable member 4*a* with the latch at an end of the arm, and a horizontal arm extending from the rotatable member 4*a* toward an interior of the waste container. The weight 5 is at a distal end of the second arm. The first and second arms form a right angle at the rotatable member 4*a*.

One potential shortcoming of the waste container 10 shown in FIGS. 1-4, is that the design may not prevent the lid 14 from opening when the container falls over on its side (e.g., accidentally by a person placing waste in the container, or by a raccoon or other animal attempting to get inside). In such instances, gravity or other centrifugal forces may pivot the weighted latch lever 4 out of its locked position, which can result in the unintentional opening of the lid 14. This can lead to spillage of, or access to, the contents of the container 10.

FIGS. 5-11 illustrate another embodiment of a waste container 10' with a gravity latch mechanism. The waste container 10' includes a lid 1 pivotably connected at one end to a container body 12.

The lid 1 includes a gravity actuated locking or latching mechanism 22' having a latch arm 30 and a separate latch hook 32 (that is, unlike the container of FIGS. 1-4, the latch arm 30 and latch hook 32 are two separate pieces). The latch arm 30 and latch hook 32 are connected through a hinge tube 34 surrounding an axle 35. The axle 35 is fastened to the lid 1 and allows the latch arm 4 and hook 32 to rotate together about the axle 35 in the manner discussed above.

Figure 7B:
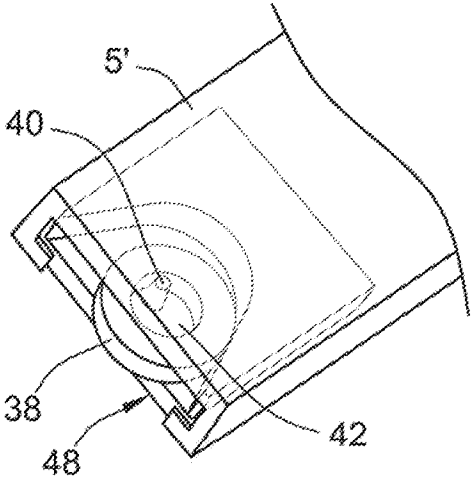
FIGS. 7A, 7B and 7C are perspective views of a secondary weight used in the container of FIG. 5 in a first position, a second position and a third position, respectively.
Figure 7C:
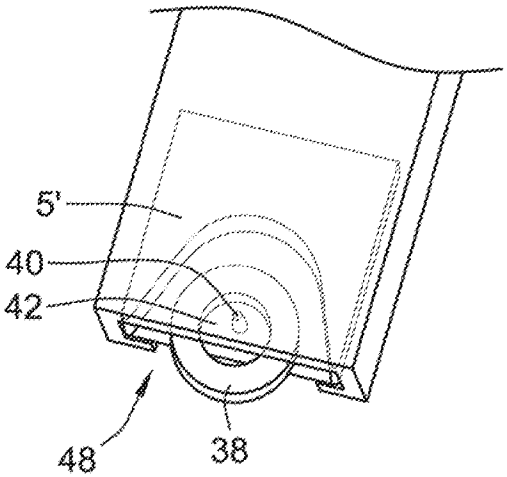
Figure 7A:
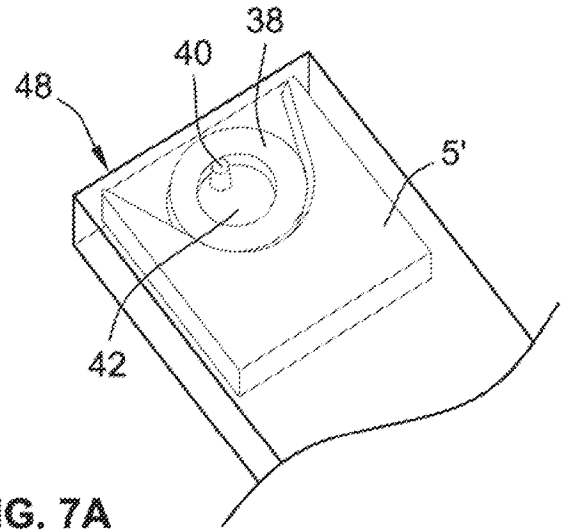
Figure 8:
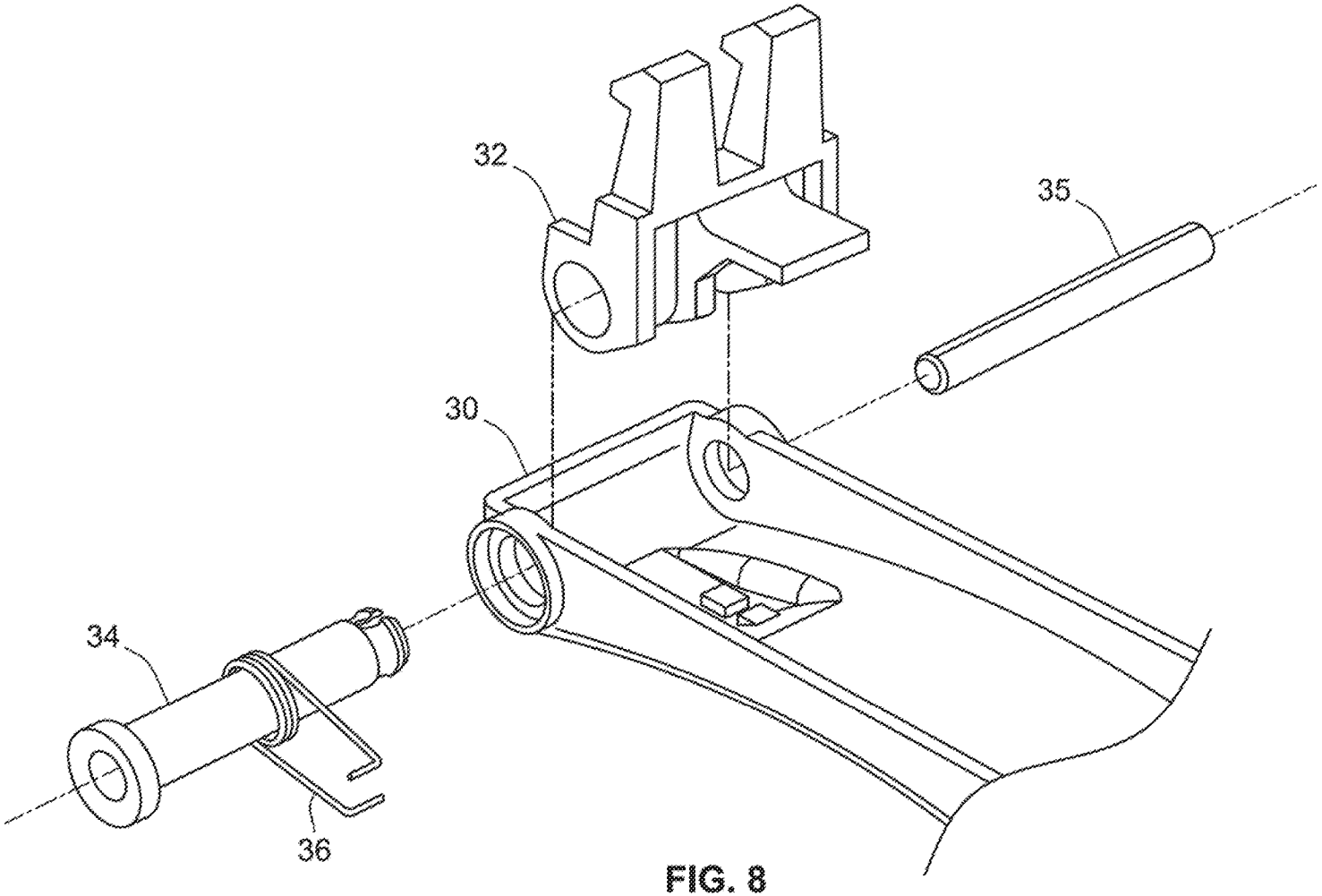
FIG. 8 is an exploded view of a pivoting end of a latch arm of the container of FIG. 5.

Additionally, the latch hook 32 in the embodiment of FIGS. 5-11 can move (i.e., rotate) relative to the latch arm 30 by a small amount (approximately 12° to15°). A torsion spring 36 surrounds the hinge tube 34 and exerts a rotational force between the latch arm 30 and the latch hook 32. The torsion spring 36 is configured to bias the hook 32 to extend generally perpendicular to the latch arm 30. An exploded view of these components (i.e., the pivoting end of the latching mechanism 22') is shown in FIG. 8. Although a torsion spring is shown, other types of springs or spring-like elements (e.g., compression or elastomeric springs) can be used.

A first, primary weight 5' is connected to the latch arm 30 at an end of the latch arm 4 distal from the end proximate the hook 32. The first primary weight 5' functions in the same manner as the weight 5 shown with respect to the embodiment in FIGS. 1-4. That is, the weight 5' causes the latch arm 30 and hook 32 to engage the catch 24 on the container body 12 when in the upright position and to rotate the latch arm 30 and hook 32 when upside down, enabling the lid 1 to open.

In addition to the first primary weight, the latching mechanism 22' of the embodiment of FIGS. 5-11 includes a second, secondary weight 38. The second weight 38 is shaped like a ring washer having a central opening 42. As illustrated in FIGS. 6 and 7A-C, the center of the second weight 38 is positioned over a post or projection 40 extending from a portion of the first weight 38.

A cover plate 7' separates the mechanism 22' from the interior of the container body 12. The cover plate 7' includes a ledge 44 positioned above the first and second weights 5' and 38 (i.e., in the direction of rotation of the weights) as shown, for example, in FIG. 6. In this regard, the ledge 44 can be any other locking feature or structure that is capable of engaging the weight 38 (when it has moved to an appropriate position as discussed herein) and preventing the latch arm from rotating.

As illustrated in FIGS. 7A-C, the second or secondary weight 38 can slide freely about the projection 40 in a generally U-shaped pocket 48 formed by the primary weight 5' and the latch arm 30. In this regard, weights having other shapes with a central opening can also be used.

FIGS. 7A-C show the position of the secondary weight 38 relative to the primary weight 5' (which is locked in position with respect to the latch arm 30), depending on the orientation of the cart 12. FIG. 7A shows the secondary weight 38 in a first position—wherein the weight 38 rests along a bottom of the U-shaped pocket 48—when the container 12 is in an upside down position for dumping its contents. FIG. 7B shows the secondary weight 38 in a second position—wherein the weight 38 rests along one of the sides of the U-shaped pocket 48—when the container 12 is laying on one of its sides. FIG. 7C shows the secondary weight 38 in a third position—wherein the weight 38 is not resting against the walls of the U-shaped pocket 48—when the container 12 is in a normal upright position (or laying on its back with the handle down).

When the container is moved sideways or backward the secondary weight 38 extends beyond the edge of the U-shaped pocket 48 and the back edge of the primary weight 5'—as is the case of FIGS. 7B and 7C. In these instances, the secondary weight 38 catches the ledge 44 and prevents the latch arm 4 and hook 32 from rotating because of the primary weight 5' and thus keeps the lid 1 locked to the container body 12.

Figure 9:
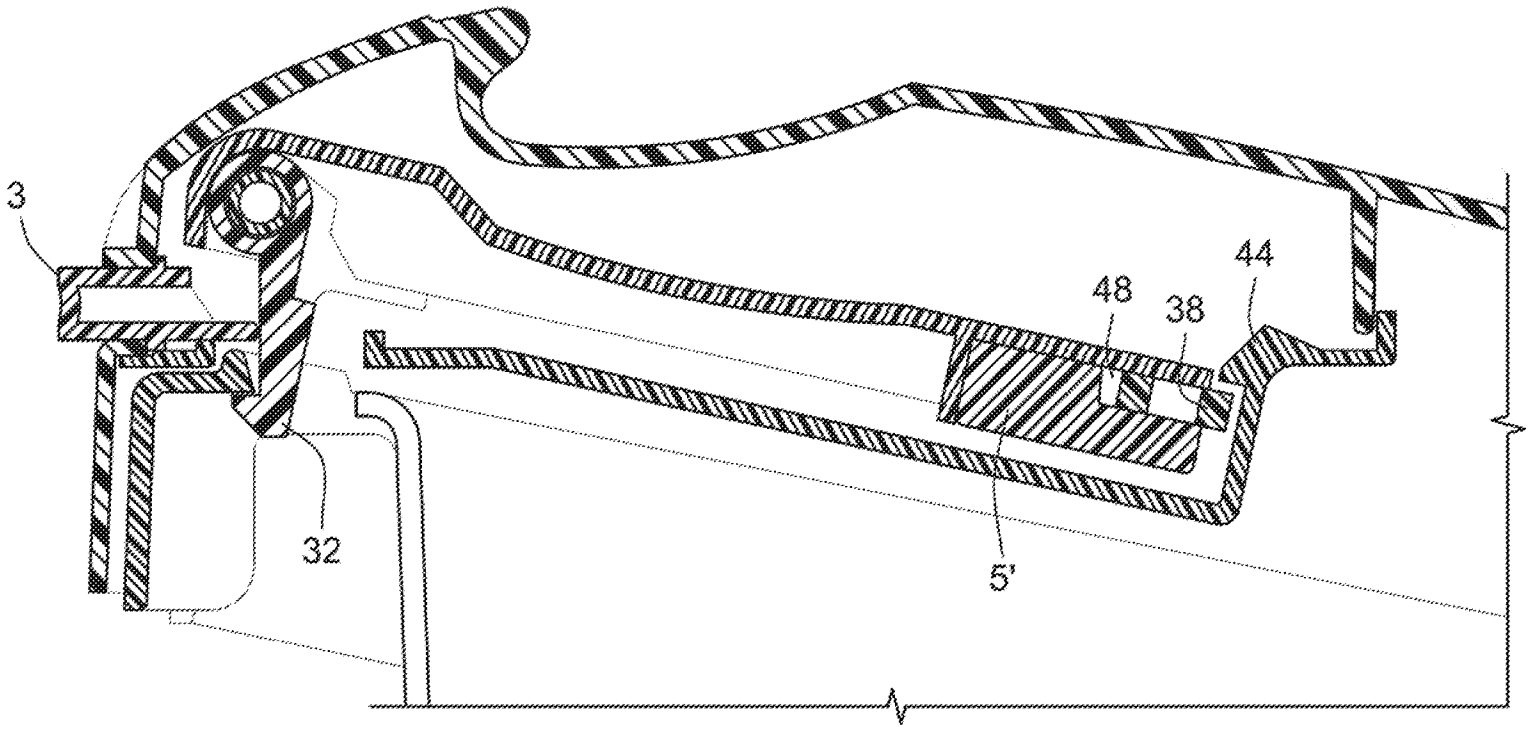
FIG. 9 is a cross-sectional view of the container of FIG. 5 with the secondary weight positioned to catch the ledge and prevent the latch arm from rotating (e.g., when the container is on its side or back)

FIG. 9 illustrates operation of the secondary weight 38 when the container is on its side or back. As shown, the secondary weight 38 moves to the edge of the pocket 48 formed by the primary weight 5'. In this position, a portion of the secondary weight 38 is positioned under the ledge 44 in the cover plate 7'. This portion will contact the ledge 44 and prevent the latch arm 30 from rotating, and in turn, rotating the latch 32, keeping the lid 1 in a closed position.

Figure 10:
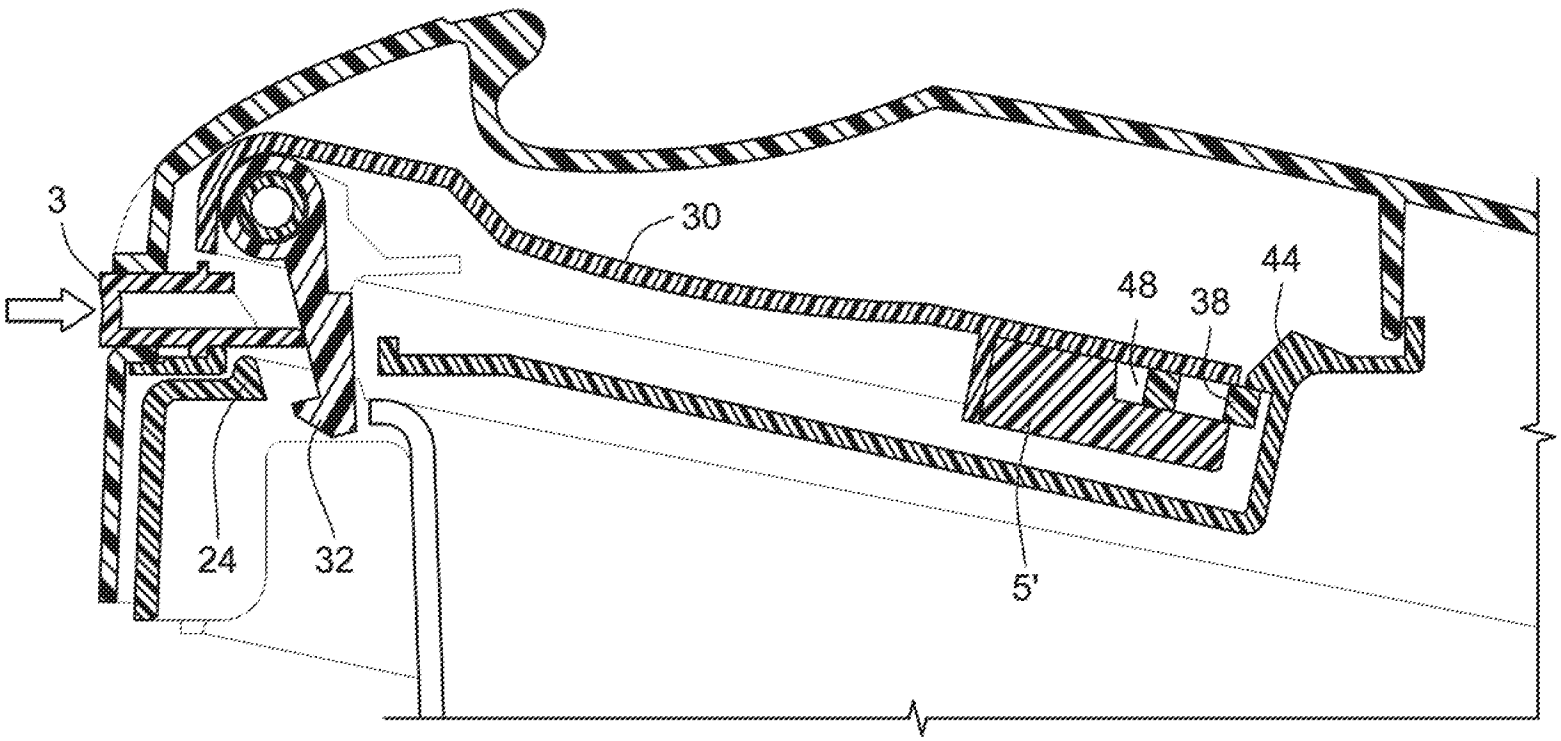
FIG. 10 is a cross-sectional view of the container of FIG. 9 with button depressed to unlatch the lid by independently rotating and moving the hook with respect to the latch arm.

As illustrated in FIG. 10, the lid 1 can still be opened in such situations by utilizing the push button 3—even if the secondary weight 38 catches the ledge 44 (which prevents the latch arm 30 from rotating). This is because the hook 32 is a separate component from the latch arm 30 (i.e., it is not rigidly connected to or an integral part of the latch arm as in the embodiment of FIGS. 1-4) and can move independently from the latch arm 30. As discussed above, the hook 32 is connected to the latch arm 30 via the hinge tube 34, axle 35 and torsion spring 36, and therefore can rotate relative to the latch arm 30. The force needed to push the button 3 and move the hook 30 is determined by the strength of the torsion spring 36.

Figure 11:
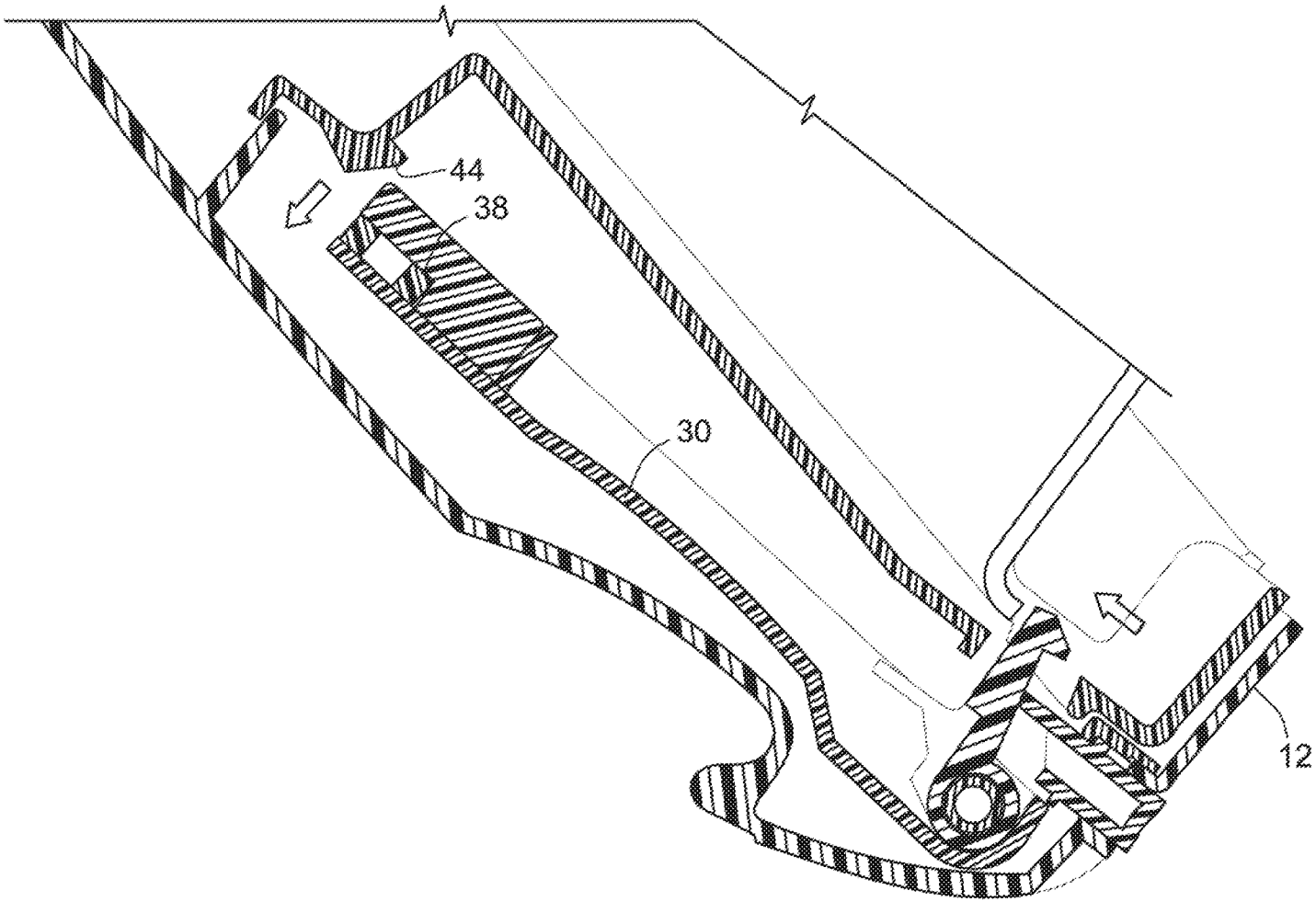
FIG. 11 is a cross-sectional view of the container of FIG. 9 in an upside down position showing the secondary weight allowing the latch arm to rotate.

As illustrated in FIG. 11, when the container is upside down, the secondary weight 38 slides to a position in the pocket 48 that does not overlap the ledge 44. Accordingly, the primary weight 5' will cause the latch arm 30 to rotate—which will cause the hook 32 to rotate and unlatch the lid 1 from the container body 12.

While the secondary weight is shown as a ring with a central opening, other shapes or configurations can be used. Moreover, the secondary weight could be replaced with a pivoting member or mechanism, or some other similar moveable member or mechanism. Additionally, the moveable and locking structures could be reversed so that the secondary weight, or other pivotable or moveable member or mechanism, can be connected to the lid and can engage a ledge or other type of locking member on the latch arm.

In certain instances it is desirable to deactivate the latch mechanism so that it does not lock each time the lid is closed when the container is in an upright position. For example, if the container is kept in an indoor facility (e.g., a warehouse), there may be no (or little) concern that a raccoon or other animal may attempt to open it.

In such instances, the latch can be deactivated by moving either the catch on the container or the latch hook on the lid so that they do not engage each other when the lid is closed. FIGS. 12-16 show embodiments of deactivation systems that move the catch on the container body. In each embodiment, the catch is part of a separate piece connected to the container body and is not integrally formed with the container body (in contrast to the catch 24 shown, for example, in the embodiment of FIG. 2).

FIGS. 12-15 illustrate one embodiment of a latch deactivation system that can be used with the gravity latch system described above. These Figures show interaction of a latch hook 4*b* and a catch mechanism 48 mounted to the open end of a container body 50. As discussed below, the mechanism 48 is rotationally mounted to the container body 50 in this embodiment, by a bolt, rivet or other similar structure (not shown) connected to (or integral with) the underside of the platform 52. The lid and portions of the latch mechanism are not visible in these Figures.

Figure 12:
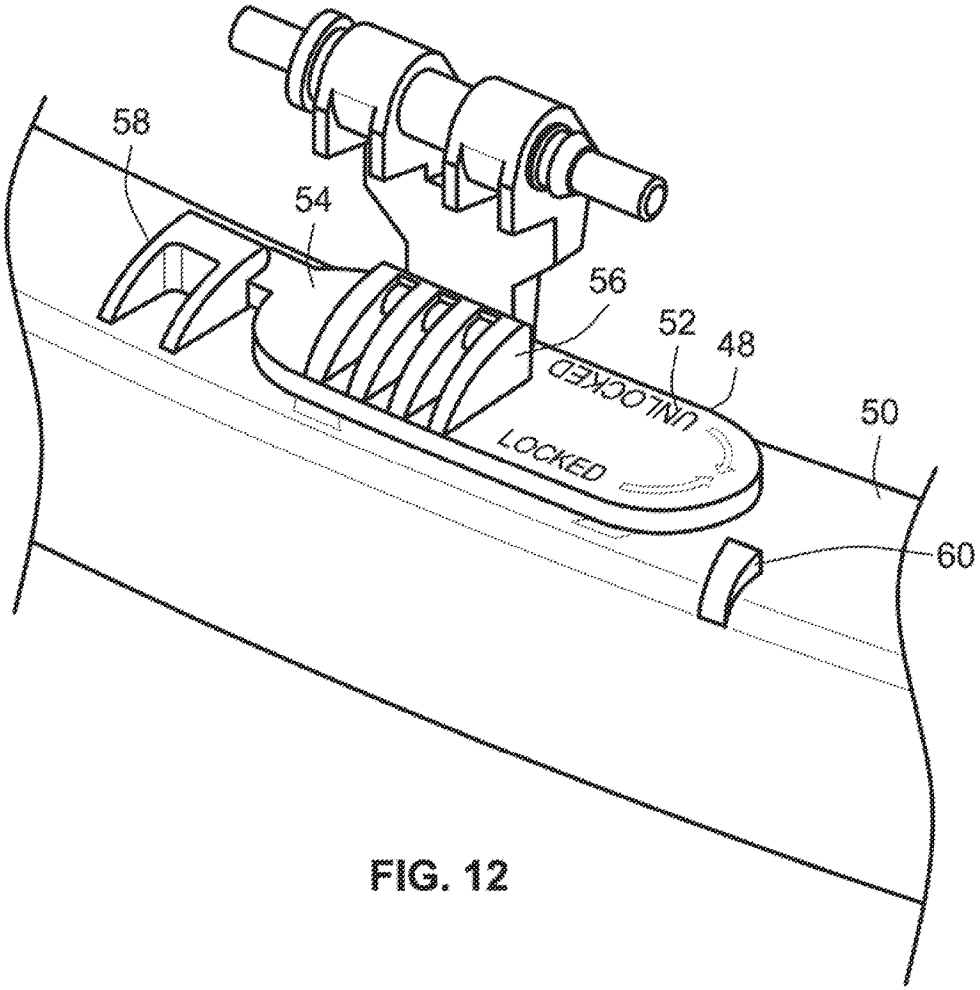
FIG. 12 is a perspective view of a latch hook and a catch mechanism of another embodiment of the invention showing the catch mechanism in a first, activated position.
Figure 13:
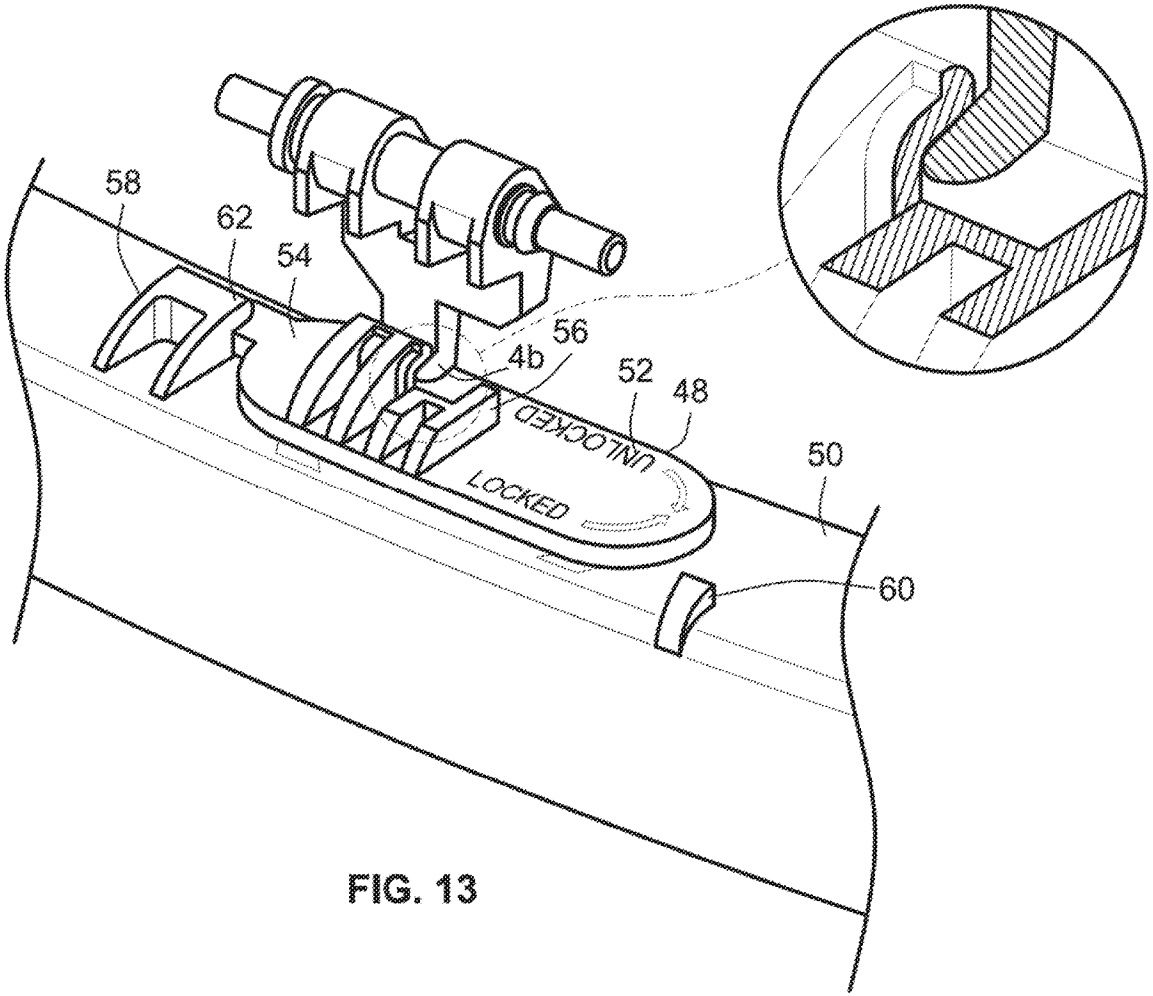
FIG. 13 is a perspective view of the latch hook and catch mechanism of FIG. 12 with a portion of the latch hook and catch mechanism cut away.

The catch mechanism 48 includes a generally oval platform 52 with a tab 54 extending outward from one end of the platform 52. A catch portion 56 is provided extending upward from the platform 52. The catch portion 56 is positioned proximate one side of the oval platform 52. As shown in FIGS. 12 and 13, the catch portion 56 is in a first, locked position and interacts with the latch hook 4*b* (of the latch mechanism) to prevent the lid from opening.

Figure 14:
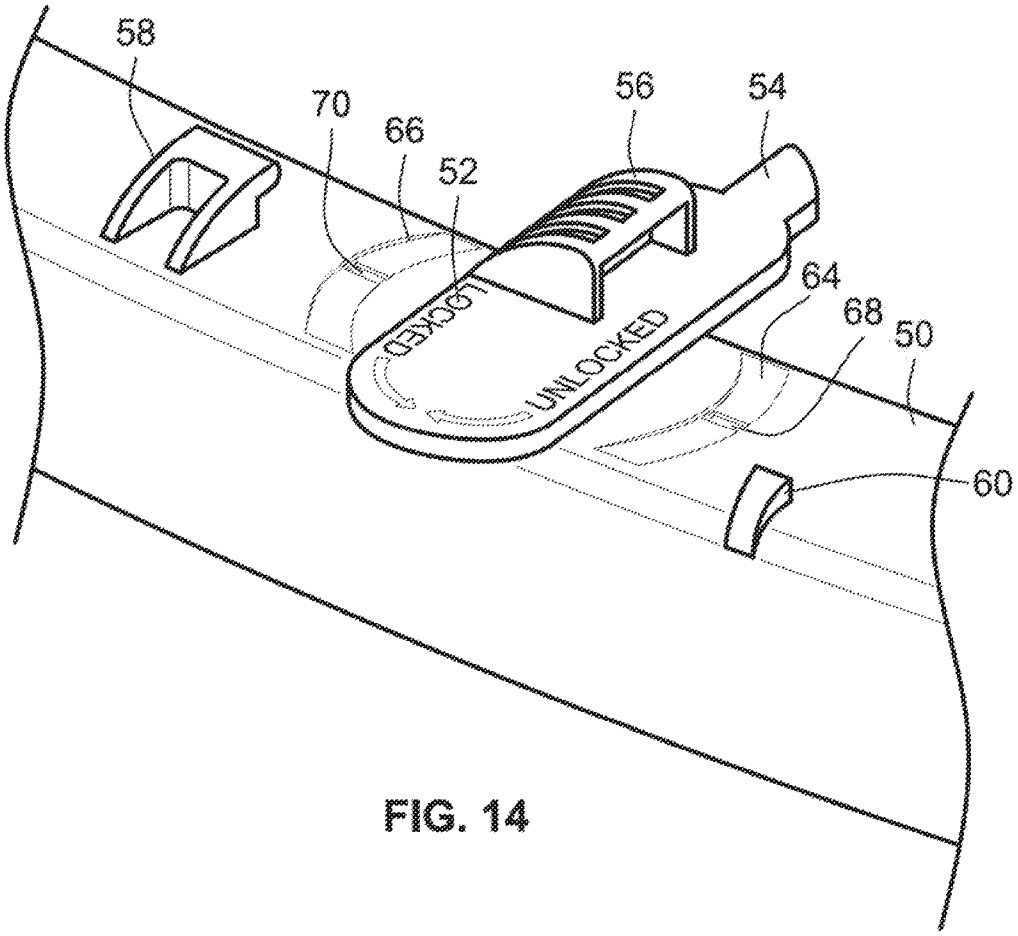
FIG. 14 is a perspective view of the catch mechanism of FIG. 12 partially moved to a second, deactivated position.
Figure 15:
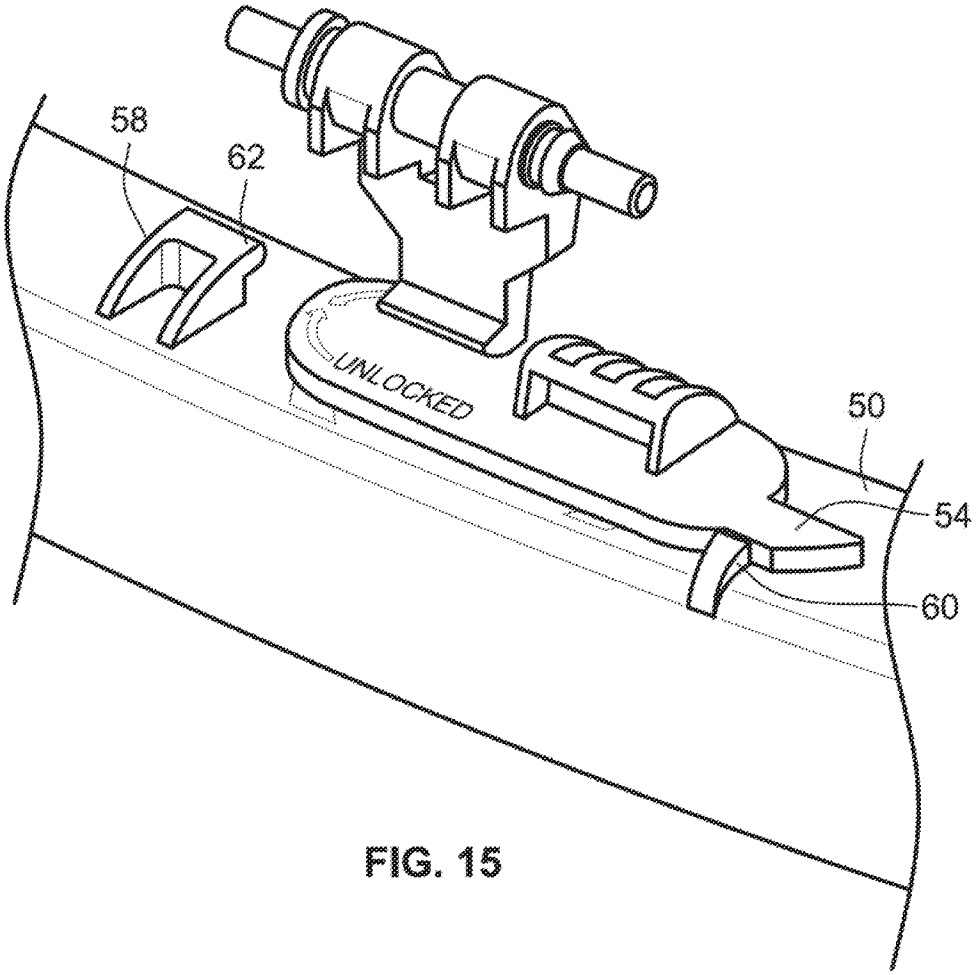
FIG. 15 is a perspective view of the latch hook and catch mechanism in the second, deactivated position; and, FIG. 16 is a perspective view of an alternative embodiment of a catch mechanism with a latch hook shown in a first, activated position.

In order to deactivate the latch mechanism, the catch mechanism 48 is rotated 180° as illustrated in FIGS. 14 and 15. During rotation, the tab 54 leaves a raised extension 58, which acts as a first stop, on one side of the catch mechanism 48 and moves until it hits a second stop 60 on the other side of the catch mechanism 48. The result of the rotation is placement of the catch portion 56 of the mechanism 48 in a second position as shown in FIG. 15. In this second position, the catch portion 56 is moved out of alignment with the latch hook 4*b* (and is facing the opposite direction), and will not engage the latch hook 4*b* when the lid is closed. This prevents the lid from locking.

The first stop 58 is provided with an overhang portion 62. The overhang portion 62 (in addition to the mounting structure) assists in keeping the catch mechanism 48 secured to the container body 50 when the catch portion 56 engages the latch hook 4*b*. That is, the overhang 62 absorbs some of the forces applied to the catch portion 56 when an attempt is made to lift the lid while the latch hook 4*b* is contacting the catch portion 56. The second stop does not necessarily include an overhang because the catch portion 56 is not engaging the latch hook 4*b*. However, one could be provided if desired (e.g., to more securely maintain the catch mechanism in the second—unlocked position).

As shown in FIG. 14, the top of the container body 50 includes two grooves 64, 66 that are covered by the catch mechanism 48 when in the first (i.e., activated) position or second (i.e., deactivated) position. Each groove 64, 66 includes a centrally located recess 68, 70. The grooves 64, 66 and recesses 68, 70 cooperate with protrusions (not shown) on the bottom of the platform 52 of the catch mechanism 48 to center and properly locate the catch mechanism 48 in the first and second positions.

In the embodiment of FIGS. 12-15, the catch mechanism 48 must be in either the first position or the second position for the lid of the container to close properly. If the catch mechanism 48 is between positions (e.g., as shown in FIG. 14), a portion of the catch mechanism will protrude outward and prevent the lid from fully closing. This acts as an indicator that the catch mechanism 48 is not in the first or second position and therefore will not function properly.

Figure 16:
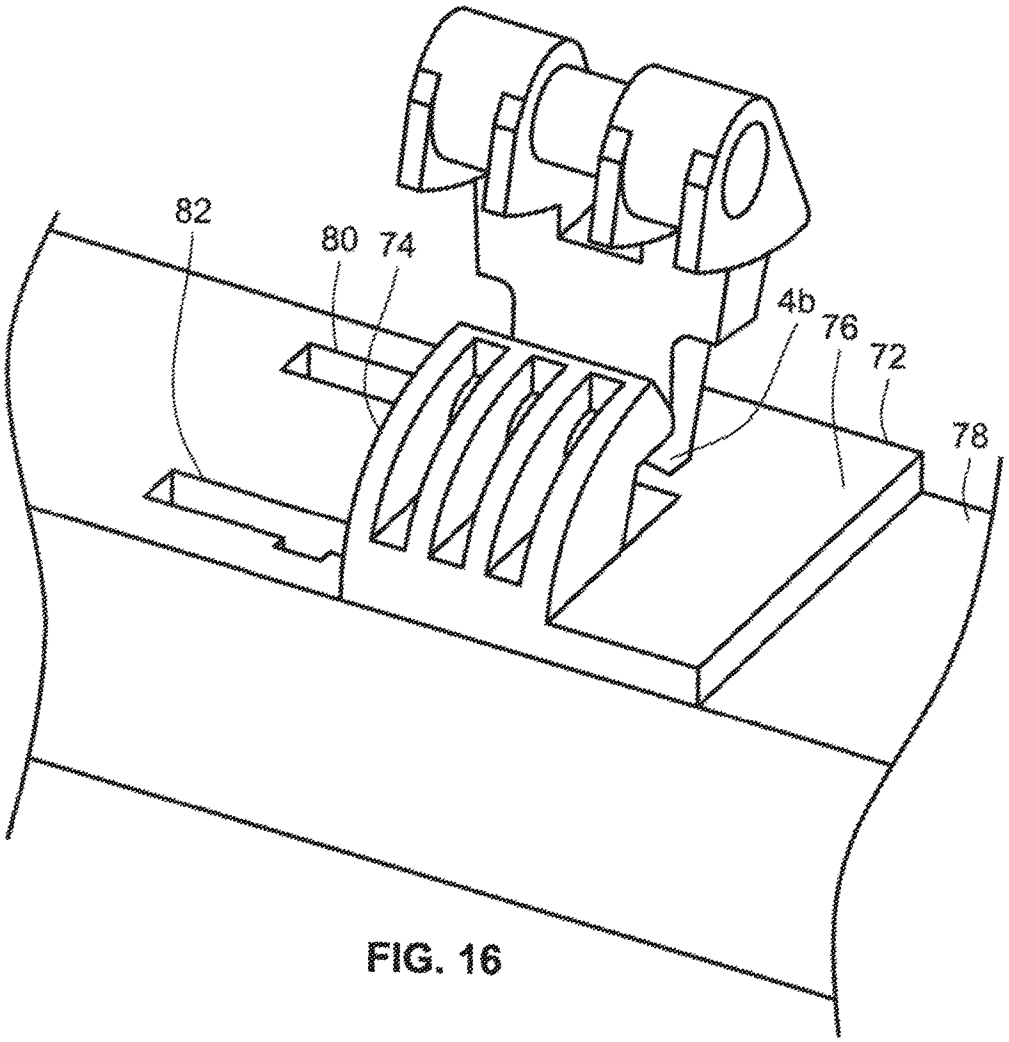

Another embodiment of a moveable catch mechanism 72 is shown in FIG. 16. In this embodiment, a catch portion 74 is on a platform 76 mounted for slideable movement on the container body 78. The top edge of the container body 78 includes a first groove 80 and a second groove 82 that interacts with structure (not shown) on the bottom of the platform 76 to allow for sliding movement of the catch mechanism. The catch mechanism 72 is shown in a first, activated position where the catch portion 74 engages the latch hook 4*b*. The catch mechanism 72 can be moved to the left to a second, deactivated position where the catch portion 74 is not aligned with the latch hook 4*b*.

While various structures can be used to inhibit or prevent any movement of the slidable catch mechanism 72 once it is set, there is a possibility that the mechanism 72 can move from one position to the other when the lid is closed. For example, if the container is tipped or knocked over on its side, the catch mechanism 72 could slide from an activated position to a deactivated position (or visa versa). In contrast, the catch mechanism 48 of the embodiment of FIGS. 12-15 is trapped in position when the lid is closed and cannot move if the container is knocked over.

The key to the lock deactivation system is taking the catch portion 56 and the latch hook 4*b* out of alignment so they cannot engage each other when the lid is closed. FIGS. 12-16 illustrate embodiments where the catch portion is moved from a first, aligned position to a second unaligned position. However, similar results can be obtained by movement of the latch hook 4*b* (this can be used where the catch portion is integral with the container body and cannot be moved). For example, the latch hook can be configured so that the hook portion can be turned (i.e., rotated) or moved (e.g., slid) into the interior of the container. Alternatively, the hook portion can be configured to snap downward (or other direction) to take it out of alignment with the catch portion. Further, the latch hook can be removable.

As shown, the catch mechanism can be labeled (i.e., include some form of indicia) to indicate whether it is in a locked position or unlocked position.

Many modifications and variations of the present invention are possible in light of the above teachings. It is, therefore, to be understood within the scope of the appended claims the invention may be protected otherwise than as specifically described.

We claim:

1. A container with a latch deactivation system comprising:

a container body having an open top portion and a catch mechanism connected proximate the top portion, the catch mechanism having a catch portion moveable from a first position on the container body wherein the catch portion is positioned to be engaged from an interior of the container to a second position on the container body spaced from the first position;

a lid pivotably connected to the top portion of the container body;

a latch hook connected to an interior portion of the lid, the latch hook aligned to engage the catch portion of the catch mechanism when the catch portion is in the first position to lock the lid to the container body when the lid is closed, wherein the latch hook does not engage the catch portion when the catch portion is in the second position to keep the lid unlocked when the lid is closed, and wherein the catch mechanism is connected to a lip of the container body and includes a horizontal platform supporting the catch portion when the container body is in an upright position and wherein the catch mechanism is mounted to the container body for rotational movement about a point on the container body between the first position and the second position.

2. The container of claim 1 wherein the platform includes a tab extension.

3. The container of claim 2 wherein the container body includes a first stop that contacts the tab extension and limits rotational movement of the platform when the catch portion is moved to the second position.

4. The container of claim 3 wherein the container body includes a second stop having an overhang that engages the tab extension when the catch portion is in the first position.

5. The container of claim 1 wherein the latch hook is rotatably mounted to the lid.

6. A waste container comprising:

a container body having a bottom and a sidewall extending upward from the bottom to a top opening;

a lid pivotably connected at a first end to a first side of the top opening of the container body;

a catch mechanism connected to the container body proximate the top opening, the catch mechanism including a catch portion moveable from a first position on the container body wherein the catch portion is positioned to be engaged from an interior of the container to a second position on the container body spaced from the first position;

a lock including a rotatable member connected to an interior portion of the lid, a first arm extending from the rotatable member, the first arm having a latch element for engaging the catch portion of the catch mechanism on the container body when the waste container is in an upright position and the catch portion is in the first position to lock the lid, and wherein the latch element does not engage the catch portion when the catch portion is in the second position.

7. The waste container of claim 6 wherein the catch mechanism is rotatably mounted to the container body.

8. The waste container of claim 7 wherein the catch mechanism is connected to a lip of the container body and includes a horizontal platform supporting the catch portion when the container body is in an upright position.

9. The waste container of claim 8 further including a first stop on a first side of the catch mechanism and a second stop on a second side of the catch mechanism.

10. The waste container of claim 9 wherein the first stop prevents further rotational movement of the platform once the catch portion is in the second position.

11. The waste container of claim 9 wherein the second stop includes an overhang portion to assist in holding the latch mechanism to the container body when the catch portion is in the first position.

12. The waste container of claim 6 wherein the catch mechanism is slidably mounted to the container body.

13. The waste container of claim 12 wherein the container body includes a first groove and a second groove configured to cooperate with the catch mechanism for the slideable movement.

14. A waste container with a gravity latch and a latch deactivating system comprising:

a container body having a bottom wall, a side wall extending upward from the bottom wall, and an open top;

a lid pivotably connected to the open top;

a gravity locking mechanism having a latch arm connected to an interior portion of the lid, a rotatable hinge portion, a latch element connected to a first end of the latch arm and a first weight connected to the latch arm; and, a catch portion on the container body, wherein the latch element being moveable from a first interior facing latch arm engaging position when the container is in an upright position with the lid closed to a second non-engaging position spaced from the first engaging position when the container is in an upright position with the lid closed.

15. The waste container of claim 14 wherein the catch portion is rotationally moveable from the first engaging position to the second non-engaging position.

16. The waste container of claim 14 wherein the latch element is linearly moveable from the first engaging position to the second non-engaging position.

17. A container with a latch deactivation system comprising:

a container body having an open top portion and a catch mechanism connected proximate the top portion, the catch mechanism having a catch portion with an overhang portion, the catch portion rotatably moveable from a first position with the overhang portion facing an interior of the container body to a second position with the overhang facing an exterior of the container body;

a lid pivotably connected to the top portion of the container body;

a latch hook connected to an interior portion of the lid, the latch hook aligned to engage the catch portion of the catch mechanism when the catch portion is in the first position to lock the lid to the container body when the lid is closed, and wherein the latch hook does not engage the catch portion when the catch portion is in the second position to keep the lid unlocked when the lid is closed.

18. A container with a latch deactivation system comprising:

a container body having an open top portion and a catch mechanism connected proximate the top portion, the catch mechanism having a catch portion moveable from a first position on the container body wherein the catch portion is positioned to be engaged from an interior of the container to a second position on the container body spaced from the first position;

a lid pivotably connected to the top portion of the container body;

a latch hook connected to an interior portion of the lid, the latch hook aligned to engage the catch portion of the catch mechanism when the catch portion is in the first position to lock the lid to the container body when the lid is closed, wherein the latch hook does not engage the catch portion when the catch portion is in the second position to keep the lid unlocked when the lid is closed, and wherein the latch hook is rotatably mounted to the lid such that the latch hook rotates with respect to the lid.

19. A container with a latch deactivation system comprising:

a container body having an open top portion and a catch mechanism connected proximate the top portion, the catch mechanism having a catch portion moveable from a first position on the container body wherein the catch portion is positioned to be engaged from an interior of the container to a second position on the container body spaced from the first position;

a lid pivotably connected to the top portion of the container body;

a latch hook connected to an interior portion of the lid, the latch hook aligned to engage the catch portion of the catch mechanism when the catch portion is in the first position to lock the lid to the container body when the lid is closed, wherein the latch hook does not engage the catch portion when the catch portion is in the second position to keep the lid unlocked when the lid is closed, and wherein the catch mechanism is connected to a lip of the container body and includes a horizontal platform supporting the catch portion when the container body is in an upright position and wherein the catch mechanism faces an interior of the container body and is mounted for linear movement along a horizontal plane to move the catch portion from the first position on the container body to the second position on the container body.

20. The container of claim 19 wherein the container body includes a first groove which cooperates with the platform for the linear movement.

21. A container with a latch deactivation system comprising:

a container body having an open top portion and a catch mechanism connected proximate the top portion, the catch mechanism having a catch portion moveable from a first position on the container body wherein the catch portion is positioned to be engaged from an interior of the container to a second position on the container body spaced from the first position;

a lid pivotably connected to the top portion of the container body;

a latch hook connected to an interior portion of the lid, the latch hook aligned to engage the catch portion of the catch mechanism when the catch portion is in the first position to lock the lid to the container body when the lid is closed, wherein the latch hook does not engage the catch portion when the catch portion is in the second position to keep the lid unlocked when the lid is closed, and wherein the catch mechanism is connected to a lip of the container body and includes a horizontal platform supporting the catch portion when the container body is in an upright position and wherein the latch hook is rotatably mounted to the lid.

* * * * *